US009919351B2

(12) United States Patent
Walde et al.

(10) Patent No.: US 9,919,351 B2
(45) Date of Patent: Mar. 20, 2018

(54) METHOD FOR PRODUCING POT-SHAPED COMPONENTS IN A SHAPING PROCESS

(71) Applicant: Adval Tech Holding AG, Niederwangen (CH)

(72) Inventors: Tom Walde, Freiburg im Breisgau (DE); Adrian Marti, Urtenen-Schonbuhl (CH)

(73) Assignee: Adval Tech HOLDING AG, Niederwangen (CH)

( * ) Notice: Subject to any disclaimer, the term of this patent is extended or adjusted under 35 U.S.C. 154(b) by 469 days.

(21) Appl. No.: 14/389,967

(22) PCT Filed: Mar. 28, 2013

(86) PCT No.: PCT/EP2013/056712
§ 371 (c)(1),
(2) Date: Oct. 1, 2014

(87) PCT Pub. No.: WO2013/149938
PCT Pub. Date: Oct. 10, 2013

(65) Prior Publication Data

US 2015/0093591 A1 Apr. 2, 2015

(30) Foreign Application Priority Data

Apr. 2, 2012 (CH) ..... 455/12

(51) Int. Cl.
*B21D 22/20* (2006.01)
*B21D 22/21* (2006.01)
(Continued)

(52) U.S. Cl.
CPC ..... *B21D 22/20* (2013.01); *B21D 22/21* (2013.01); *B21D 51/22* (2013.01); *B21D 22/28* (2013.01);
(Continued)

(58) Field of Classification Search
CPC .... B21D 22/20; B21D 22/206; B21D 22/225; B21D 22/21; B21D 22/22; B21D 22/24;
(Continued)

(56) References Cited

U.S. PATENT DOCUMENTS 4,562,719 A * 1/1986 Budrean ..... B21D 51/54 72/349
5,722,282 A * 3/1998 Mine ..... B21D 22/30 72/348
8,037,810 B2 * 10/2011 Leidecker ..... B23P 15/10 29/888.04

FOREIGN PATENT DOCUMENTS

DE 935 186 C 11/1955
DE 2 315 832 A1 10/1974
(Continued)

OTHER PUBLICATIONS

English machine translation of FR2387706A1 dated Dec. 16, 2016.*
(Continued)

*Primary Examiner* — Teresa M Ekiert
*Assistant Examiner* — Gregory Swiatocha
(74) *Attorney, Agent, or Firm* — Sughrue Mion, PLLC

(57) ABSTRACT

A method for producing a pot-shaped component from a flat blank. The method comprises the following steps: a) shaping the flat blank in at least one deep-drawing step to form a pot-shaped raw component having a substantially flat bottom area and a circumferential frame, and b) shaping the pot-shaped raw component in a tool having a conically tapered die that applies shear to the circumferential surface of the frame in the axial direction against the conically tapered die. In step b), the bottom area is clamped between an ejector and a hold-down mechanism and the conically
(Continued)

tapered die surrounds the bottom area of the raw component radially on the outside and extends in a diameter-reducing manner in a tool stroke.

28 Claims, 9 Drawing Sheets

(51) Int. Cl.

| | |
|---|---|
| ***B21D 22/28*** | (2006.01) |
| ***B21D 22/30*** | (2006.01) |
| ***B21D 51/22*** | (2006.01) |
| ***B21D 24/00*** | (2006.01) |
| ***B21D 24/02*** | (2006.01) |
| ***B21D 24/04*** | (2006.01) |
| ***B21D 24/10*** | (2006.01) |

(52) U.S. Cl.
CPC ..... *B21D 22/30* (2013.01); *B21D 24/005* (2013.01); *B21D 24/02* (2013.01); *B21D 24/04* (2013.01); *B21D 24/10* (2013.01); *Y10T 428/1241* (2015.01)

(58) Field of Classification Search
CPC ..... B21D 22/28; B21D 22/30; B21D 24/00; B21D 24/005; B21D 24/02; B21D 24/04; B21D 24/06; B21D 24/08; B21D 24/10; B21D 24/12; B21D 24/14
USPC ..... 72/347–351
See application file for complete search history.

(56) References Cited

FOREIGN PATENT DOCUMENTS

| | | | | |
|---|---|---|---|---|
| EP | 0 919 305 | A1 | | 6/1999 |
| FR | 2 387 706 | A1 | | 11/1978 |
| JP | 60-72617 | A | | 4/1985 |
| JP | 2001-047175 | A | | 2/2001 |
| JP | 2002-102980 | A | | 4/2002 |
| JP | 2005349433 | A | * | 12/2005 |
| JP | 2007-014978 | A | | 1/2007 |
| JP | 2009248092 | A | * | 10/2009 |
| JP | 2010-120061 | A | | 6/2010 |
| JP | 2010-214381 | A | | 9/2010 |

OTHER PUBLICATIONS

Machine Translation of JP2009-248092, Translated May 15, 2017, 16 Pages.*
Machine Translation of JP2005-349433, Translated May 15, 2017, 15 Pages.*
Written Opinion dated Oct. 2, 2014, issued by the International Searching Authority in application No. PCT/EP2013/056712.
International Search Report for PCT/EP2013/056712 dated May 16, 2013.
Written Opinion for PCT/EP2013/056712 dated May 16, 2013.

* cited by examiner

METHOD FOR PRODUCING POT-SHAPED COMPONENTS IN A SHAPING PROCESS

CROSS REFERENCE TO RELATED APPLICATIONS

This application is a National Stage of International Application No. PCT/EP2013/056712 filed Mar. 28, 2013, claiming priority based on Swiss Patent Application No. 0455/12 filed Apr. 2, 2012, the contents of all of which are incorporated herein by reference in their entirety.

TECHNICAL FIELD

The present invention relates to a method for producing pot-shaped components from a planar blank, and to corresponding components.

PRIOR ART

In the production of pot-shaped parts in a deep-drawing method, in particular from metal and for example for use in the automotive sector, the thickness of the part bottom is limited by the thickness of the starting material. This means that, in order to produce a part with a predetermined bottom thickness, it is necessary to use a starting material which has at least this desired thickness of the bottom.

Often, however, parts are required which, although they have a large bottom thickness, should have a wall thickness which is as small as possible in the region of the frame. It has not previously been possible to produce such components in a deep-drawing method; rather, it has been necessary to produce them by joining two parts, namely a thin-walled sleeve and a "thick bottom disk". The problem is, in particular, that it is generally not possible to reduce the wall thickness in the frame region to less than half the starting material thickness, otherwise the shaping capacity of the material would be exceeded.

SUMMARY OF THE INVENTION

The object of the present invention is, inter alia, to at least partially overcome this limitation of the deep-drawing process. Specifically, the proposed method is intended for producing parts whose bottom thickness is greater than the thickness of the starting material. To this end, a typically cylindrical bowl is firstly produced by a deep-drawing process and subsequently pressed into a conical die, so that thickening of the bottom part is achieved. This effect can be increased further by carrying out such a process sequence repeatedly.

First, in other words, a round bowl is preferably drawn from a planar round (blank), and this bowl is subsequently pressed into a conical die. The bowl may subsequently be pressed into a conical die again, in order to achieve further thickening of the bottom, or a cylindrical bowl may again be shaped from the conical workpiece by a further deep-drawing step.

In tests and FEM simulations, it is found that, in particular, the corner radius of the workpiece is of crucial importance for being able to achieve large thickening in the bottom region. To this end, it is important for the ejection force to be dosed correctly. If it is too low, then when the bowl is pressed in there is an excessive corner radius, so that efficient thickening is prevented. If this force is too great, then a kind of undercut is formed, which likewise prevents efficient thickening. Furthermore, the bottom of the part should be clamped above during the thickening, in order to prevent it from bulging, since this would likewise counteract a thickening process. By means of the strength of the clamping force, it is also possible to influence the extent to which the bottom is thickened in the region of the clamping. This is beneficial in terms of process technology, inter alfa when this region is subsequently intended to be provided with a hole, or have a step. With respect to the ratio of the ejection and clamping forces, it may be stated that the clamping force should in principle be less than the ejection force. In order to achieve an optimal result, the level of the difference of the two forces is important, and its optimal value depends on the specific geometry of the process, the tribo system and the material of the workpiece.

On the basis of the shaping introduced in the region of the bottom, the proposed method also achieves material strengthening, so that the component also has a greater strength than the base material in this region, which is not possible in a conventional deep-drawing process.

In the scope of the tests, it is furthermore found that, by a suitable sequence of deep-drawing and ironing operations after the thickening of the bottom, it is possible to produce parts which have very sharp corner radii for parts produced in a deep-drawing method.

Specifically, the present invention relates to a method for producing a pot-shaped component from a flat blank, wherein the pot-shaped component has an essentially planar bottom region and a circumferential frame adjacent thereto, rising from the bottom region. The blank has a first material thickness D essentially over its entire area, and the bottom region has a second material thickness $D_9$, which is greater than the first material thickness D.

The method is, in particular, characterized by at least the following steps a) shaping the planar blank in at least one deep-drawing step to form a pot-shaped raw component having an essentially planar bottom region and a circumferential frame adjacent thereto, rising from the bottom region, b) shaping this pot-shaped raw component in a tool having a conically tapering die and a preferably path-controlled shear element (instead of this, however, the die may be path-controlled) exerting a shear on the circumferential surface of the frame of the raw component in the axial direction against the conically tapering die.

During this second step b), the bottom region of the raw component is clamped at least locally between an ejector and a retainer. Furthermore, the conically tapering die encloses the bottom region of the raw component, guiding this bottom region radially on the outside and in a diameter-reducing manner in the tool stroke.

By this management of the process, in the second step b) on the one hand the frame is compressed to a certain extent by the shear, and possibly swaged in a thickening manner. At the same time, however, the bottom region is pushed together in a thickening manner radially with respect to the symmetry axis.

A similar method may also be carried out for a step section, either in addition to the above-described formation of a thicker bottom region or instead thereof. Such a step section is a section in which a component plane is arranged perpendicularly to the axis of the component, and such a region can likewise be correspondingly thickened. Preferably, in such a case of a step section, since it is not continuous in the direction of the central axis in contrast to a bottom section, in the scope of step b) the internal aperture of the step section is stabilized by a punch engaging through the former, so that the region is in fact thickened and not simply pushed radially inward. When the bottom region is referred to below, this also includes such a step section.

It is moreover possible that, before or after step b), optionally for example in the scope of step a), holes and/or cutouts are formed in the bottom region, or also in the frame, or that these elements are formed in a stepped fashion, with horizontal, vertical or conical steps. Specifically in the case of horizontal steps, these, as mentioned above in the context of step sections, may likewise be thickened. Particularly when holes are formed in the bottom region before step b), it is preferred for the internal aperture of this hole to be stabilized by a punch engaging through it in the scope of step b), so that the bottom is actually thickened and not simply pushed radially inward with reduction of the hole.

When deep drawing is referred to below, this generally means a process in which the drawing gap is not limited, that is to say the drawing gap is wider than the material guided through it at the start. When ironing is referred to below, this includes actual ironing using a sharp edge at an angle of typically 12-18°, but it also includes deep drawing with limitation of the drawing gap, that is to say other methods in which the wall thickness is tapered in a controlled way but a sharp ironing edge is not necessarily used. Correspondingly also included are processes using a smoothing die, in which in contrast to a deep-drawing die the radius of the rounded region merges into the cylindrical region not tangentially but at an angle, typically 5-20°, normally 12-18°.

In principle, the method may be carried out under thermally regulated conditions both in the scope of step a) and particularly in the scope of step b), that is to say at a temperature at which an increased ductility of the material can be used. This is possible, for example, by heating the starting material and/or the tool parts in a controlled way. Hot forming, particularly in the scope of step b), or optionally subsequent steps, may even be envisioned.

In order not to hinder this thickening of the bottom by an excessive clamping force between the ejector and the retainer in the scope of step b), it is preferable that the retaining force of the retainer during the shaping tool stroke in step b) is less than the counterforce of the ejector. The difference between the two forces in absolute value is preferably adjusted in such a way that the defect states represented below in FIGS. 5 and 6 do not occur.

Another preferred embodiment is characterized in that step a) comprises at least one first deep-drawing step for forming a rising frame, and optionally at least one second shaping step, in which the radius of the transition region between the bottom region and the frame is reduced. The frame is preferably pressed and/or deep-drawn in a wall thickness-reducing manner or height-increasing manner in the scope of this step or in the scope of at least one further step. In particular, it may prove important that, before step b), the radius in the transition region between the bottom region and the frame is already small enough to ensure, for this step b), sufficiently controlled displacement of the material in the plane of the bottom surface toward the symmetry axis.

Another preferred embodiment is characterized in that, following step b), the component is subjected to at least one shaping step in which the frame is converted from an orientation conically tapering toward the bottom region into a cylindrical, preferably circular-cylindrical, orientation at least over a part of the height, preferably over the entire height, of the frame. Preferably, at the same time or in the scope of one or more additional processing steps, the frame is pressed and/or deep-drawn so as to increase its height.

The result of step b) is normally a component which has a frame widening upward. Such a design is suitable for certain applications, but in other designs, if the frame is intended to extend parallel, such a subsequent step is then necessary.

Normally, the pot-shaped component is rotationally symmetrical.

According to a preferred embodiment, the second material thickness $D_9$ is the same essentially over the entire bottom region. The material thickness may, however, also be controlled deliberately by the clamping, that is to say it may be formed in a stepped manner because of the clamping between the retainer and the ejector. By corresponding structuring, for example stepping of the clamping surface of the retainer and/or ejector, it is also possible to impose a very controlled surface structure in this clamping region.

Another preferred embodiment is characterized in that the second material thickness $D_9$ is at least 1.25 times as great as the first material thickness D, preferably at least 1.5 times as great as the first material thickness D, particularly preferably at least 1.75 times as great than the first material thickness D.

It is thus possible, according to another preferred embodiment, that in the resulting component after step b) or optionally after further subsequent steps, as mentioned above and explained in detail below, the second material thickness $D_9$ is at least 1.5 times as great as the material thickness $D_9'$ of the frame, preferably at least 1.75 times as great, particularly preferably at least 2 times as great.

Typically, the blank consists of metal, preferably steel, or in particular metals preferably selected from the following group:

- steel, in particular DC01, DC02, DC03, DC04, DC05, DC06, 1.4016, 1.4000, 1.4510, 1.4301, 1.4303, 1.4306, 1.4401, 1.4404
- nickel and (tempered) deep-drawable alloys thereof, in particular 2.4851
- copper and (tempered) deep-drawable alloys thereof, in particular brass
- tantalum, molybdenum and niobium and (tempered) deep-drawable alloys thereof
- tungsten and (tempered) deep-drawable alloys thereof, in particular with rhenium being alloyed in addition
- aluminum and (tempered) deep-drawable alloys thereof, in particular with magnesium being alloyed in addition
- magnesium and (tempered) deep-drawable alloys thereof, in particular with lithium or aluminum being alloyed in addition, in particular the alloy AZ31.

The conically tapering die preferably has a cone angle in the range of 3-20°, preferably in the range of 5-15°. If lower values are selected, the displacement of material into the bottom region is insufficient and the steps have to be repeated too often. If larger values are selected, then, particularly in the case of relatively high frames, difficulties are to be expected since the frame warps, or the like. The precise setting depends on various parameters, for example process speed, tool temperature, component temperature, friction on the tool, wall thicknesses, material, etc. An optimum setting of the parameters, in particular cone angle, clamping forces of retainer and ejector, etc., can be made without an unreasonable effort by the person skilled in the art, on the basis of visual or tactile checking of the resulting components, cf. below.

Another preferred embodiment, in which the thickness of the bottom is further increased, is characterized in that step b) is carried out at least two times, either immediately after one another or with at least one intermediate deep-drawing step, in which preferably the frame is converted from an orientation conically tapering toward the bottom region into a cylindrical, preferably circular-cylindrical, orientation at least over a part of the height, preferably over the entire height, of the frame.

Such a method may be carried out in a continuous or quasi-continuous process, preferably from a roll, by starting material being supplied and the blank being cut, particularly preferably stamped, from the starting material in at least one processing step which precedes step a).

Lastly, the present invention also relates to a pot-shaped component, in particular made of a metallic material, having an essentially planar bottom region and a circumferential frame adjacent thereto, rising from the bottom region, and produced by a method as described above, wherein the material thickness $D_9$ of the bottom region is preferably at least 1.5 times as great as the material thickness $D_9'$ of the frame, preferably at least 1.75 times as great, particularly preferably at least 2 times as great. In this case, furthermore, owing to the shaping-induced strengthening of the material in the bottom region, component properties are produced which—for a given base material—cannot be achieved by other production methods. For a specimen component produced from the material DC04LC (yield point about 210 MPa, HV1 about 107 to 111), the yield point of the bottom region was increased in two deep-drawing steps to about 240 MPa. In the subsequent first thickening step (1.1 mm to 1.3 mm), the yield point in the bottom region was increased to about 400 MPa (HV10 about 151 to 166) and in a second thickening step (1.3 mm to 1.7 mm) to about 450 MPa (HV10 about 176 to 181), the corresponding values of the yield points (except for the base material) being determined with the aid of FEM shaping simulations, as explained in more detail below, and the hardness values being measured on the real components. In general, the specific increase in the strength compared with the base material is dependent on the specific geometry of the component, on the material used and on the shaping temperature. The resulting strength may, however, already be determined at least approximately in advance from the comparative shaping factors in the bottom region and the corresponding creep curve of the base material. In the case of cold forming, the creep curve may, for example, be determined approximately with the aid of the formula which is specified in Standard EN10139:1997 Annex B under B1.2: $\sigma=K*\epsilon^n$, where $\sigma$ stands for the yield stress and $\epsilon$ stands for the comparative strain. K and n represent material parameters, K standing for a material-dependent constant in MPa and n being the dimensionless hardening exponent. Furthermore, there are a multiplicity of other hardening laws for determining the yield stress, which may correspondingly also take the effect of temperature into account. As examples, the Johnson-Cook model (G. R. Johnson, W. H. Cook, A constitutive model and data from metals subjected to large strains, high strain rates and high temperatures, 7$^{th}$ *International Symposium on Ballistics,* 541-547 (1983)) and the Kocks-Mecking model (H. Mecking and U. F. Kocks, Kinetics of flow and strain hardening, *Acta Metall.* 29 (1981) 1865-1875). It is furthermore possible to determine the corresponding creep curve experimentally, for example in a tensile or compressive test. The comparative shaping factor may be determined either in simple cases with the aid of analytical approximation formulae or with the aid of FEM shaping simulations. The yield stress determined in this way corresponds to the new yield point in the bottom region. Furthermore, the component is free of joins.

For such a component according to the invention, the yield point of the material in the bottom region—yield point as a measure of its strength—is increased relative to the corresponding value of the starting material, in such a way that it corresponds to an increase in the comparative plastic extension of at least 5%, preferably at least 10%, in particular at least 25% in the corresponding creep curve of the starting material. As the creep curve, the technical or actual stress/strain curve may be taken as a reference, and preferably the actual stress/strain curve.

Other embodiments are specified in the dependent claims.

BRIEF DESCRIPTION OF THE DRAWINGS

Preferred embodiments of the invention will be described below with reference to the drawings, which are merely used for explanation and are not be interpreted as restrictive. In the drawings.

DESCRIPTION OF PREFERRED EMBODIMENTS

FIGS. 1-4 illustrate four different working steps in the scope of a stage sequence, individual instantaneous images of the sequence respectively being represented for each working step in order to illustrate the sequence. They are respectively half-plane sections, in other words the tools represented in the products and starting materials represented are cylindrically symmetrical, an axial section represented through the symmetry axis of the tool respectively being represented, and only one half plane respectively being represented owing to the symmetry.

Figure 1:
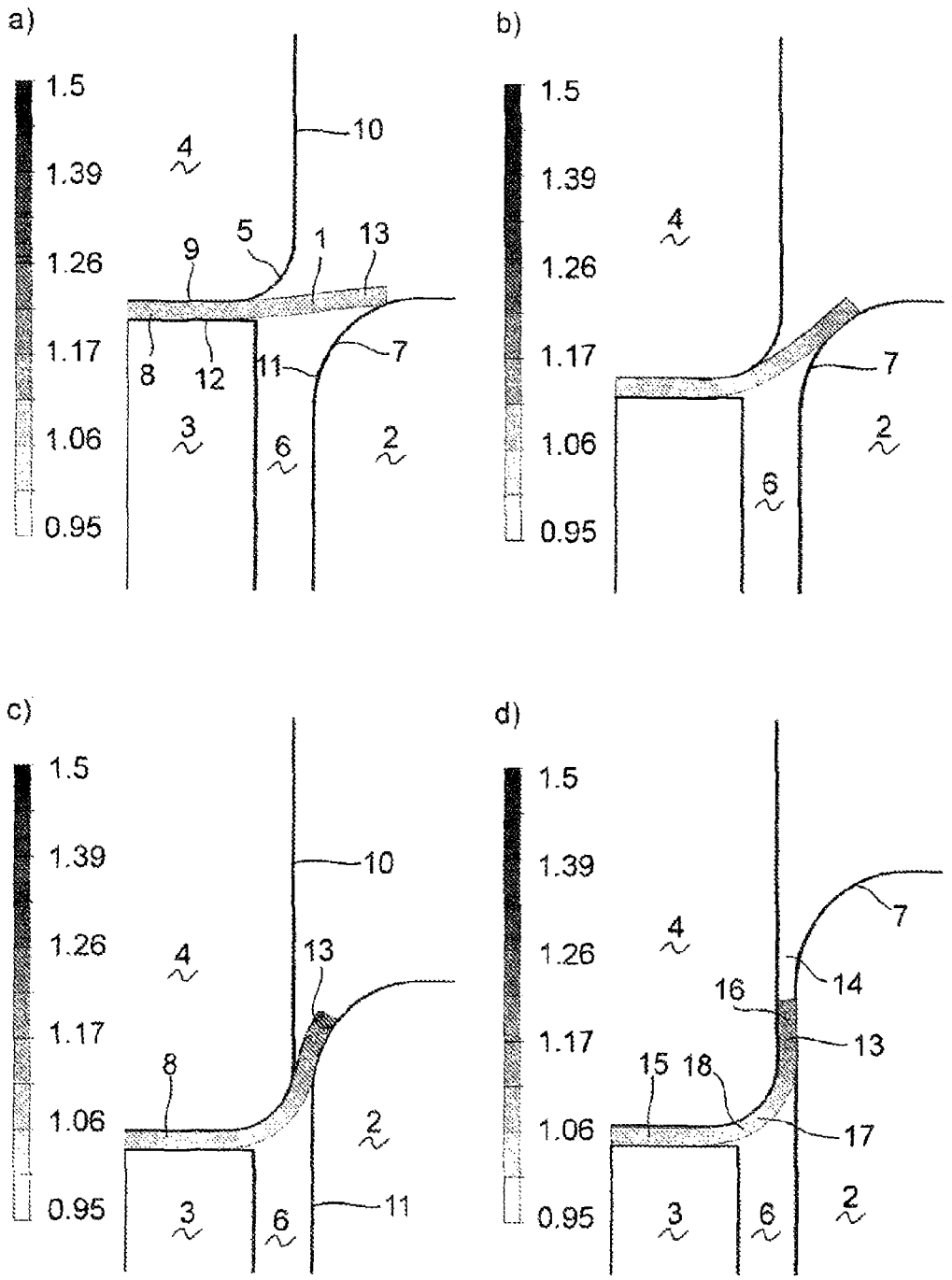
FIG. 1 shows radial half-plane sections through the individual phases a)-d) of the first step for deep-drawing of a pot from a planar blank.

In this process, a blank in the form of a circular planar stamping 1 of metal (round) is provided. Such a stamping may for example be supplied in a continuous supply method from raw material on a roll, and stamped. In a first working step as represented in FIG. 1, the blank 1 is first shaped in a deep-drawing method by circumferentially shaping the edge region in one direction to form a frame, the extent direction of which lies essentially circumferentially perpendicularly to the plane of a bottom section. This is done in such a way that the blank (cf. FIG. 1*a*) is clamped in the central region between an ejector 3 and a punch 4, specifically by its being clamped flat in its central region between the clamping region 12 of the ejector 3 and the clamping region 9 of the punch 4. The clamped region 8 is correspondingly not processed in this step, while the circumferential section 13 following radially outward is. Radially on the outside of the ejector, a die 2 is arranged. Between the die 2 and the ejector 3, an axial gap 6 remains. The upper region of the die, facing toward the punch 4, is formed with a rounded shape, as represented by the reference 7. Likewise rounded and provided as a bearing for the region 13 placed around is the circumferential lower edge part 5 of the punch 4. The curved region 5 merges into an axially extending surface region 10, formed by a circumferential cylinder surface, of the punch 4. The ejector 3 and the punch 4, together with the blank 1 clamped between these two tool elements, now move, as represented in the sequence of FIGS. 1*a-b*, successively downward so that the section 13 comes in contact with the rounded surface 7 of the die and is increasingly placed circumferentially upward, so that it initially forms a depression. By the radial relative arrangement of the cylindrical outer surface of the punch 4 and the cylindrical inner surface 11 of the die 2, a narrow gap 14 is formed, which essentially corresponds to the material thickness of the blank 1 but may also be somewhat larger. As can be seen particularly in FIGS. 1*c* and 1*d*, the shaped circumferential section 13 is now clamped in this gap in such a way that clean shaping to form a pot-shaped component 17 takes place after the first step. In this intermediate result, there is a bottom region 15 which corresponds essentially to the region clamped between the ejector 3 and the punch 4, then there is a transition region 18 curved with a relatively large radius, the shape of which essentially corresponds to the rounded region 5 of the punch, and a circumferentially rising region 16.

Although this is not the case in this method represented in FIG. 1, it is nevertheless also possible already in the scope of this step to set the gap width to be less than the material thickness of the starting material of the blank, and thereby implement first ironing/smoothing of the circumferentially rising region 16, and therefore an increase in the height of the pot.

Figure 2:
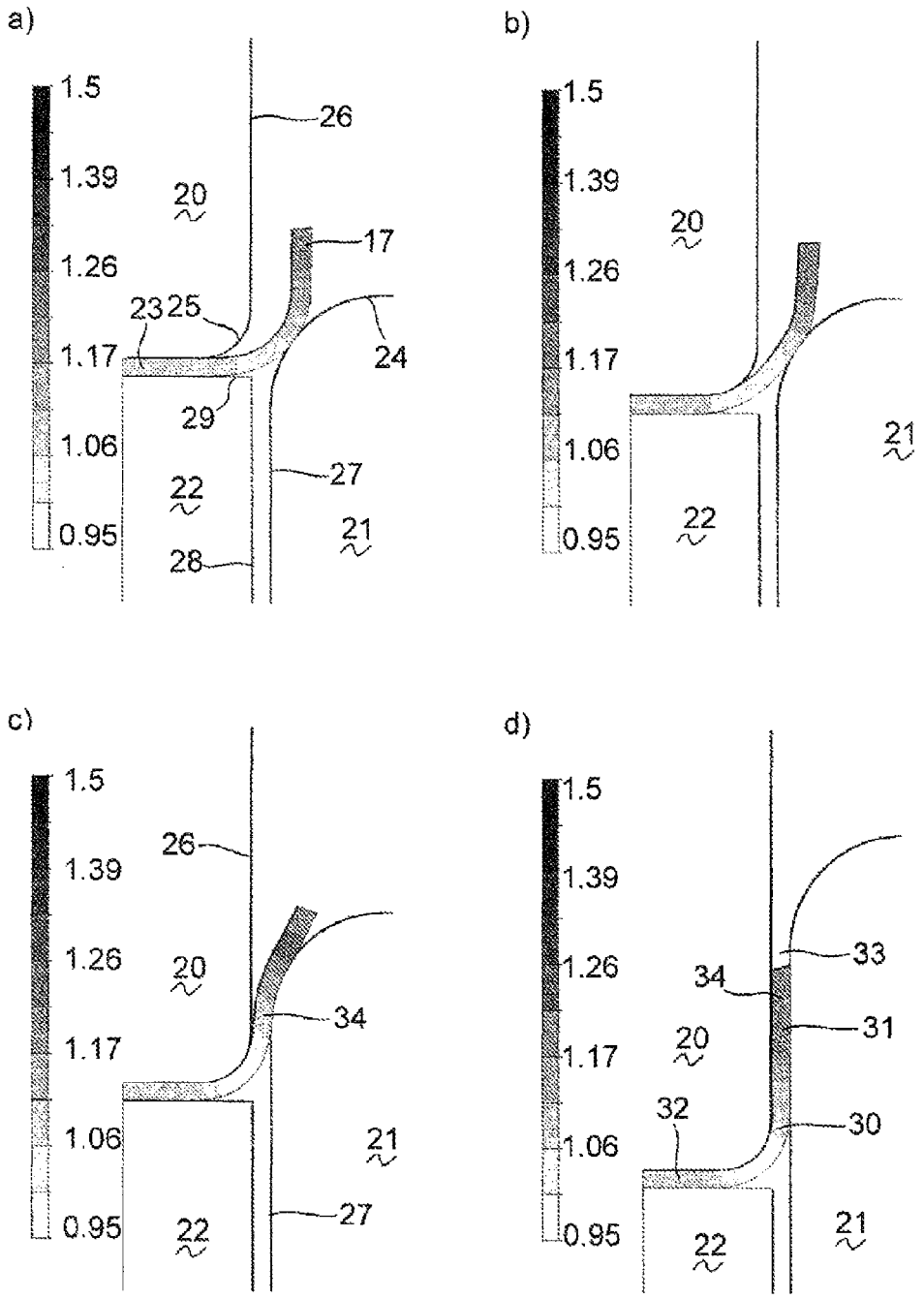
FIG. 2 shows radial half-plane sections through the individual phases a)-d) of the second step for further shaping, or deep-drawing, of a pot with a larger frame height from a deep-drawn pot from the first step according to FIG. 1.

The pot-shaped component 17, which is the result of the shaping step represented in FIG. 1, is now the starting material for the second shaping step, which is represented in FIG. 2. Again, this involves a tool with a punch 20 and an ejector 22, and the bottom region 15 of the starting material is clamped between these two tool parts in a region 23. Now, however, the punch 20 has a substantially smaller radius, and the transition region between the horizontal clamping section of the punch 20 and the gap-limiting surface 26 in the form of a circumferential cylinder surface has a radius of curvature 25 which is substantially less than in the case of the first tool according to FIG. 1. Once more, there is an outer brace in the form of a die 21, which here as well has a circumferential rounded region 24. The region 23 clamped between the punch 20 and the ejector 22 moves downward together with the elements 20 and 22 relative to the outer brace 21, and the region following radially outward is then successively shaped, as shown in the sequence of steps 2*a-b*. Between the circumferential surface 26 of the punch 20 and the cylindrical inner surface 27 of the die, a gap 33 is here again formed, between which the rising region is shaped and drawn.

The result of this second step is pot-shaped component 30, which again has a circumferential rising region 31, moreover, since the gap width of the gap 33 is here set to be more than the thickness of the starting material, it is not only shaped but simultaneously also pressed, i.e. by this process the circumferential region 31 is to some extent drawn in length. The section 34 has thus been tapered in the scope of this step by using a limited drawing gap, and the transition region from the bottom region 32 to the circumferential rising region 31 of the pot-shaped component 30 has also been reduced in its radius. The bottom region 32 still, however, essentially has the material thickness of the starting material.

Figure 3:
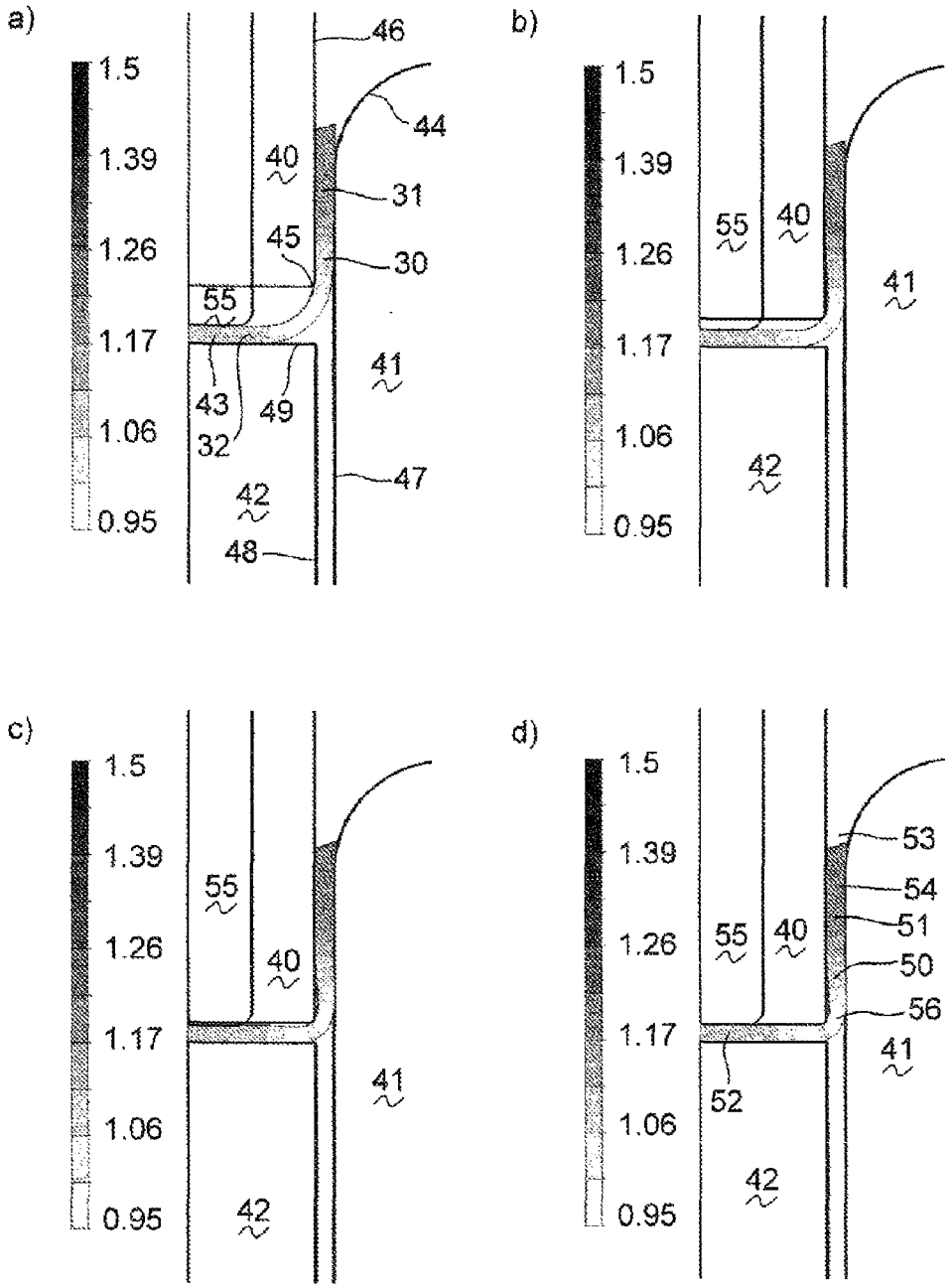
FIG. 3 shows radial half-plane sections through the individual phases a)-d) of the third step for further shaping of a pot from a pot with a larger frame height from the second step according to FIG. 2.

In a next processing step, which is represented in FIG. 3, the radius in the transition region from the bottom section 32 to the circumferential rising section 31 of the pot-shaped component 30 is now reduced even further. This is done in a tool in which the starting component 30 is now clamped in the bottom region between an ejector 42 and a retainer 55 only in the entire central region. Radially on the outside, the component is guided during essentially the entire processing step according to FIG. 3 by the die 41, the rising region being guided and displaceably clamped in the gap 53 between the gap-limiting surface 47 of the die 41 and the gap-limiting surface 46 of a punch 40. Furthermore, this punch 40 is now provided with a circumferential rounded region 45 with a very small radius. Like the retainer, it engages from above on the component. The punch 40 now moves, as is represented in the sequence of FIGS. 3*a-d*, downward relative to the retainer 55, the ejector 42 and the outer brace 41 onto the clamped region 43, respectively toward the bottom region of the starting component, so that the curved transition region between the bottom and the rising section is converted into a shape which has a very small radius of curvature. The punch 40 is moved down essentially with its lower surface onto the component until it is essentially flush with the clamping surface of the retainer 55, i.e. as far as an end state as represented in FIG. 3*d*.

Respectively on the left-hand side of represented FIGS. 1-4, a shading scale is represented, which indicates the thickness of the component in the corresponding region. As can be seen particularly in FIG. 1*a*, the starting material has a thickness of 1.1 mm. Already in the process according to FIG. 1, the way in which a slight thickening occurs owing to the shaping process by displacement of material into the upper edge region of the rising section 13 can be seen, and particularly in FIG. 2 the way in which thinning of the material takes place for the radius of curvature in the transition region between the bottom section 32 and the rising section 31 can be seen. This is also the case in FIG. 3, and must be adapted in such a way that in the tool, this applying particularly to steps 1-3, excessive tensile forces do not act on the edge region, which could cause the bottom to be stamped out to some extent and separated from the rising region.

Figure 4:
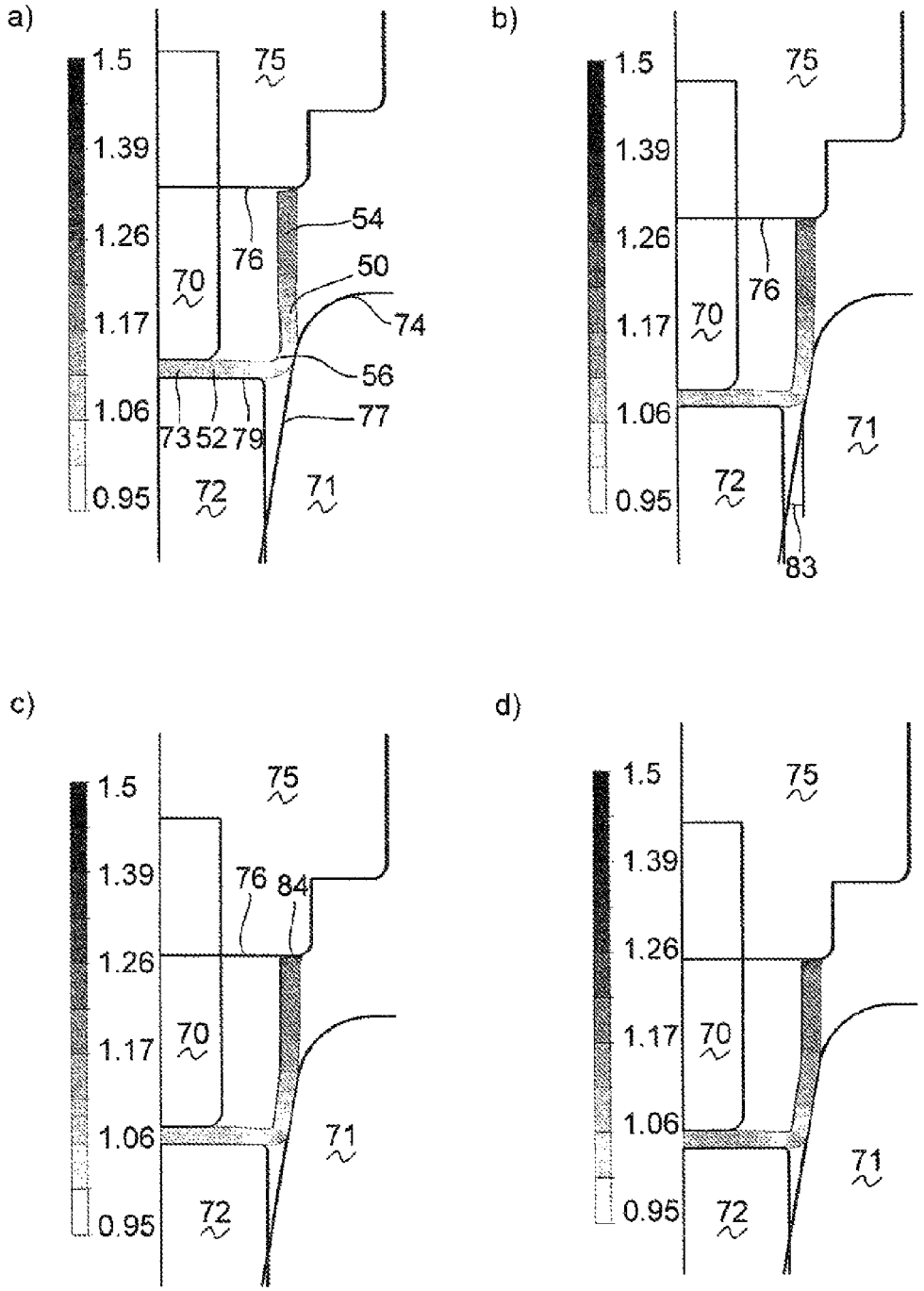
FIG. 4 shows radial half-plane sections through the individual phases a)-h) of the fourth step for thickening of the bottom of a pot from the third step according to FIG. 3.
Figure 4:
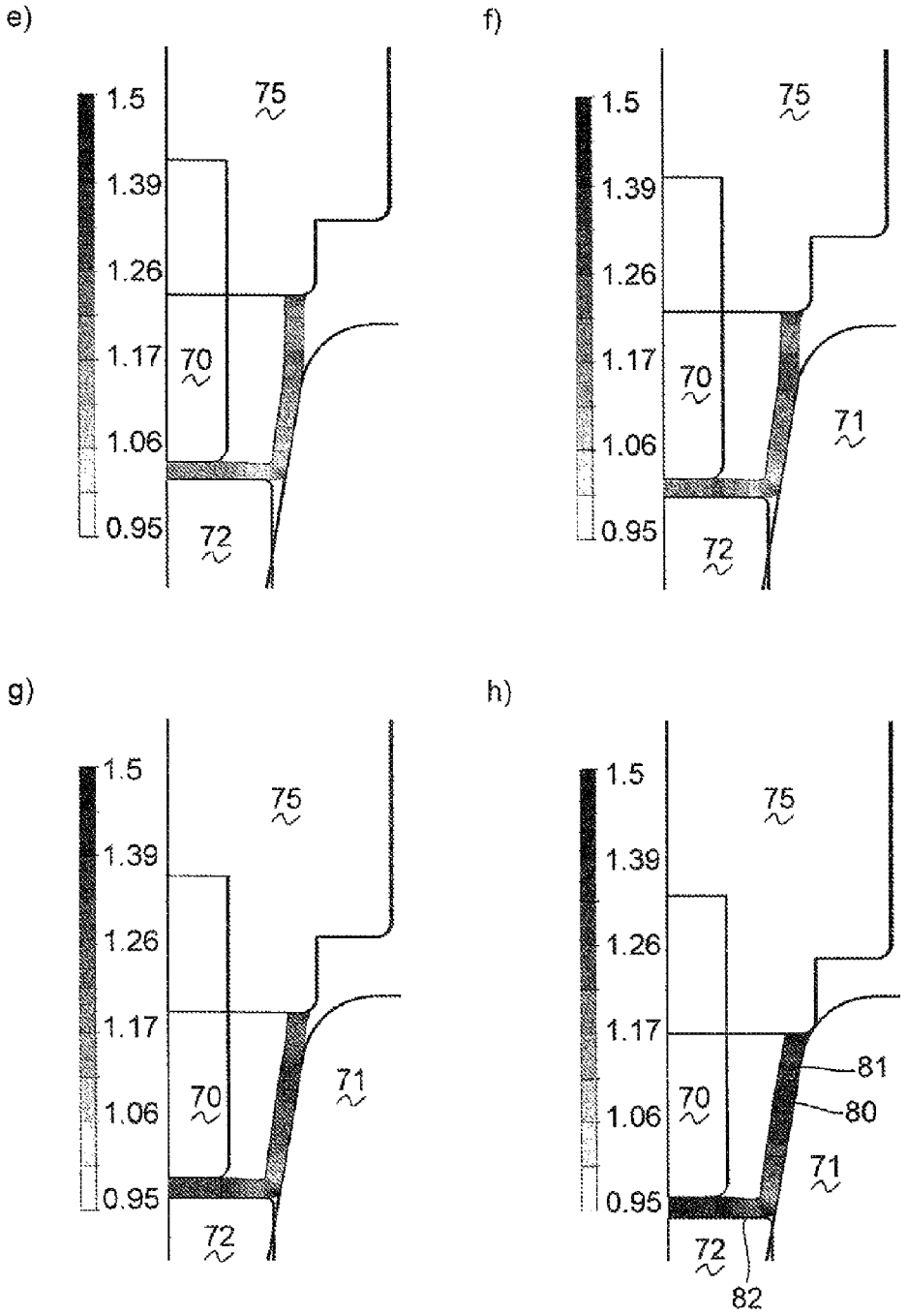

FIG. 4 shows the processing step in a fourth tool, in which, after the third step, thickening of this section is now very deliberately induced while reducing the radius of the bottom region 52 of the pot-shaped component 50. In this case, the starting component 50 from the third processing step according to FIG. 3 is clamped between an ejector 72 and a retainer 70 in the central bottom region 13. Arranged circumferentially around the ejector 72, there is a conical outer brace having a cone surface 77 widening upward, which merges in a circumferential rounded region 74 to form a region essentially extending horizontally in this representation. The cone surface 77 is at an angle, the cone angle 83, with respect to the symmetry axis of the tool. This cone angle typically lies in the range of 5-15°. Deeper cone angles make it necessary to carry out too many steps as in FIG. 4, with corresponding economic but also material technology disadvantages, and larger angles lead to problems as will be explained in detail below, and which are very similar to when the retaining force of the retainer 70, or respectively the ejector force, is not set precisely enough.

Now, in addition, a shear element 75 is provided, which bears with a radial shear surface 76 on the circumferential surface or upper edge 84 of the side wall. This shear element 75 is path-controlled, while the other tool parts 70, 71, 72 are adjusted by corresponding spring forces (the tool part 71 need not be spring-mounted). Now, the unit consisting of the retainer 70, ejector 72 and shear element 75 moves downward together with the clamped component 50, while the conical outer brace 71 remains essentially stationary. During this movement, the transition region 56 formed with a small radius comes to bear between the bottom section 52 and the rising section 54 with the cone surface 77.

By the successive further downward movement with pressure on the upper edge 84 by the shear element 75, as shown particularly in FIGS. 4*c-h*, with shortening of the radius of the bottom section 52 the latter is pushed together to a certain extent so as to thicken it, i.e. material is displaced into the middle and the material thickness in the bottom region increases.

At the same time, moreover, the rising region is deformed owing to the conical brace of the die 71 to form a rising region widening upward, as represented for the finished component by the reference 81. Since this side wall region is also pressed in a swaging fashion by the shear element 75, the component is possibly also thickened in this region as well.

The positioning and the shape of the retainer 70 are important in this case, as is in particular its radius. By the shear force directed radially inward, which is applied by the conicity of the die 71, the bottom may under certain circumstances also yield to this pressure by bulging upward, so that bulging instead of material thickening then results. Typically, the retainer should preferably cover at least one third of the radius of the bottom region at the starting time of the step, but it may also have a smaller radius. This, of course, is generally not desired, and correspondingly in this step it is important for the dimensioning and the clamping force of the retainer 70, in particular the clamping force between the retainer 70 and the ejector 72, to be set just in such a way that, although this bulging is prevented, the thickening of the material is nevertheless also made possible not only in the region where the retainer 70 does not bear, but also in the clamping region. Only if the distance between the retainer 70 and the ejector 72 can be modified in an increasing way in the course of the method step according to FIG. 4 can the desired thickening be achieved over the entire bottom region.

The result of this important processing step according to FIG. 4 is then a pot-shaped component 80 with a circumferential rising region 81 widening conically upward, the actual frame, and an essentially planar bottom region 82, and the transition region has a relatively small radius. The bottom region 82 now has a thickness which is in this case 30-40% greater than the material thickness of the starting material. If it is desired to have a component with a parallel frame, and in particular to form this frame even substantially longer, i.e. to produce a component which has a greater height, then the desired geometry may be produced in subsequent shaping steps, in which essentially only the bottom region is then clamped and the frame is pressed. The setting of the parameters in the tool, so that under the desired material shaping in the fourth step can take place reliably and accurately at the end of the process, is important and may be determined by simple test runs. The most important defect states are represented in FIGS. 5 and 6.

Figure 5:
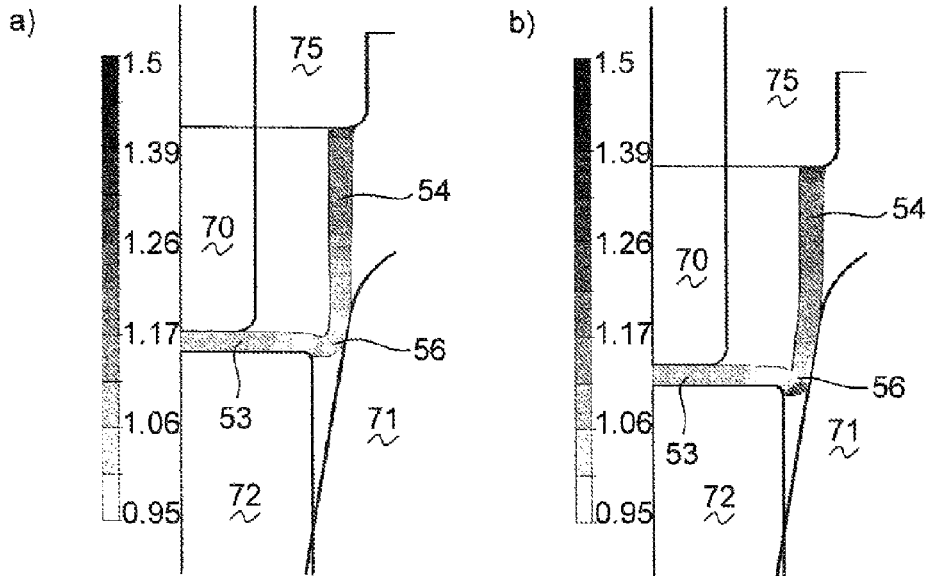
FIG. 5 shows radial half-plane sections through critical phases a) and b) when the ejector force is set too high.

If an excessive force is exerted by the shear element 75 (cf. FIG. 5), then the frame is pushed down too intensely and rapidly, i.e. at a method stage which is too early, and a circumferential bead (undercut) bulging downward, possibly blocking the whole tool, may be formed in the edge region, as represented in FIG. 5. In this case, the clamping force of the first element is thus set too high, or the spring force of the ejector 72, if the shear element 75 is path-controlled, is set too high.

Figure 6:
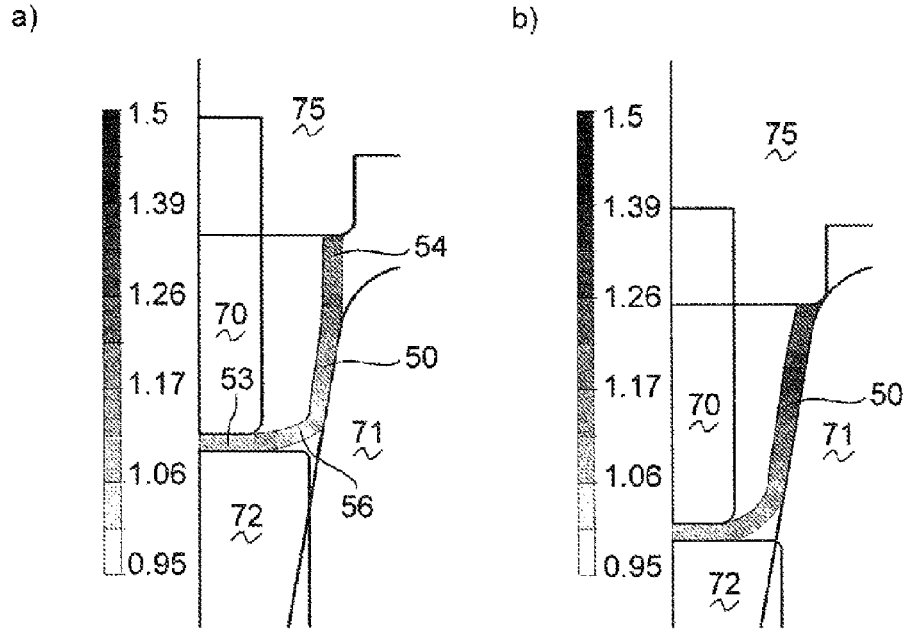
FIG. 6 shows radial half-plane sections through critical phases a) and b) when the ejector force is set too low.

FIG. 6, on the other hand, shows the situation when the counterforce of the ejector 72 is set too low. In this case, the shear element 75 pushes too little and, under the friction on the conical brace of the die, the edge region is pushed up, i.e. where the bottom section is not clamped by the retainer 70, and an unusable component likewise results, and in particular, precisely as in FIG. 5, there is no thickening of the bottom.

Figure 7:
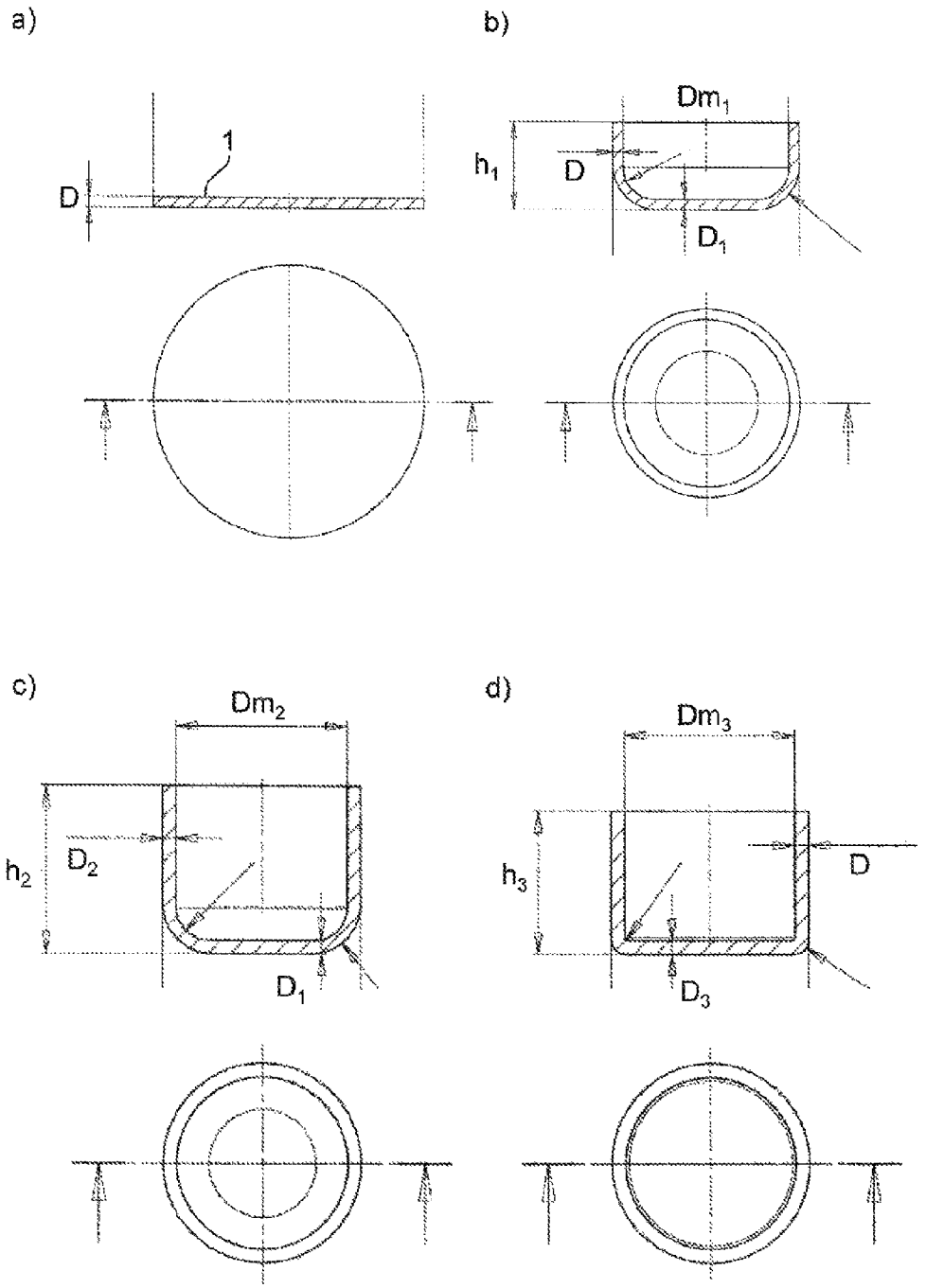
FIG. 7 shows a stage sequence in 9 stages from a blank to a finished component, a plan view respectively being given below and a sectional representation along the arrows in the lower representation respectively being given above, the blank being represented in a), the result of a first stage with a first tension being represented in b), the result of a second stage with a second tension being represented in c), the result of a third stage for swaging the corner in the bottom region being represented in d), the result of a fourth stage with first thickening of the bottom being represented in e), the result of a fifth stage for aligning the frame being represented in f), the result of a sixth stage with second thickening of the bottom being represented in g), the result of a seventh stage with further alignment of the frame being represented in h), and the results of two successive ironing steps to increase the frame height respectively being represented in i) and j)
Figure 7:
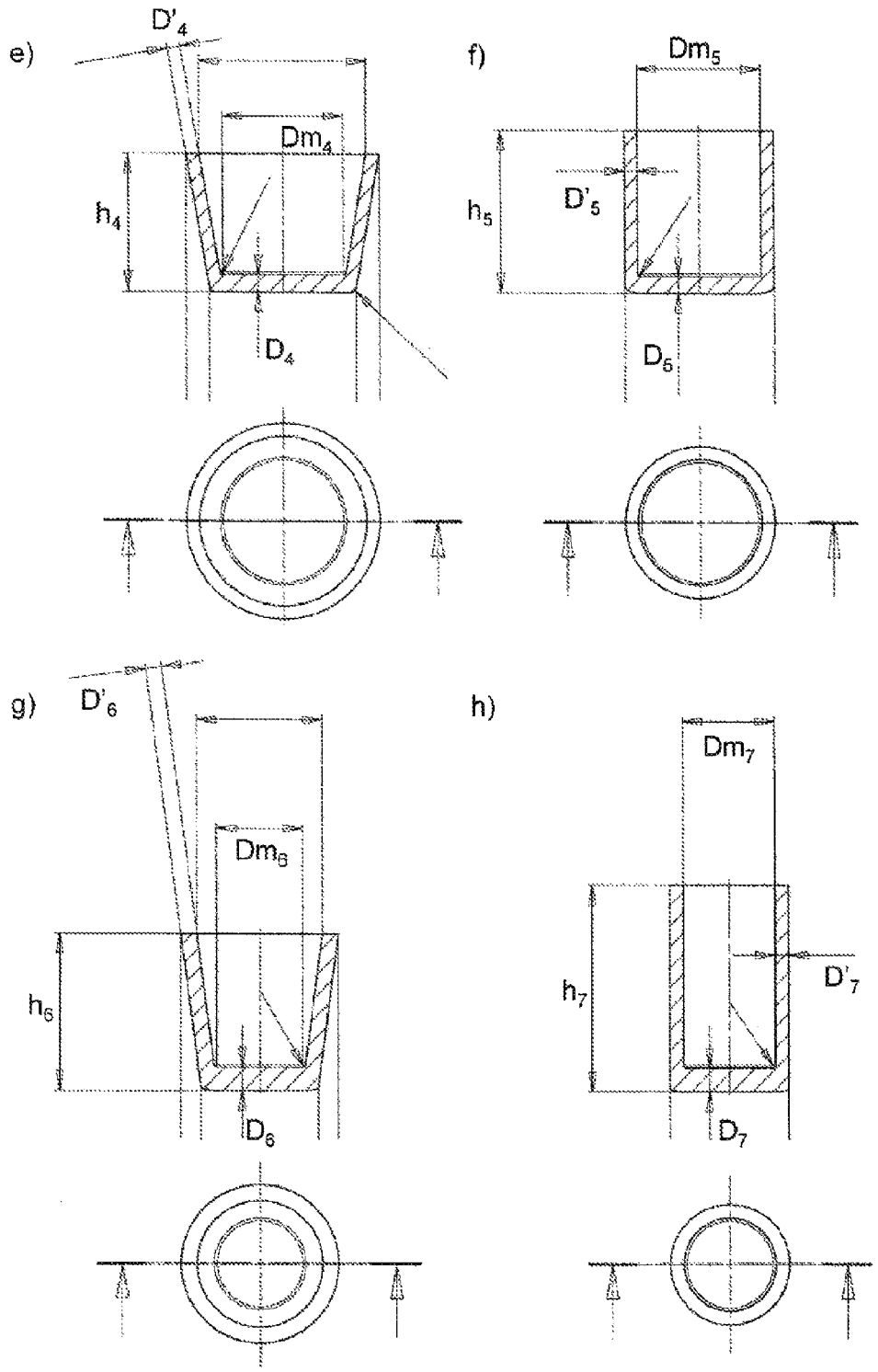
Figure 7:
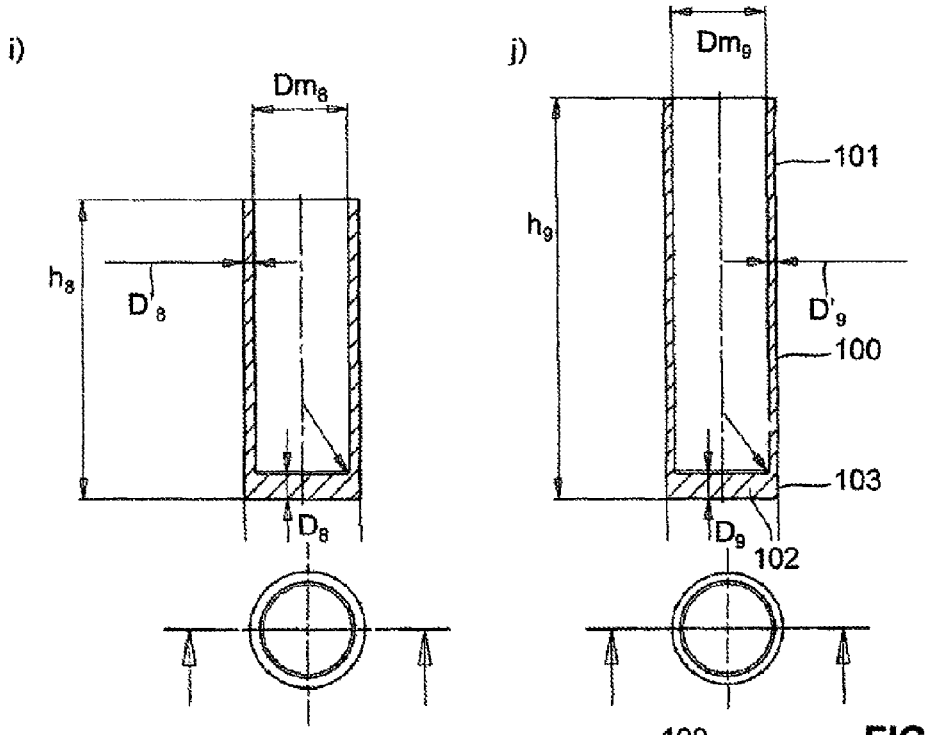

With the aid of the different states of a component in the scope of a sequence of steps, FIG. 7 shows an entire stage sequence starting from a disk-shaped blank 1 (cf. FIG. 7*a*) to a pot-shaped finished component 100 having an extremely thick bottom region 102 and a comparatively thin circumferential frame region 101. An axial section through the processing part at the top and a plan view at the bottom are respectively represented.

This stage sequence starts with a blank 1 having a thickness D. In a first step, this component is deep-drawn, the bottom optionally being very slightly thinned ($D_1$) during this method step, while the frame retains the thickness of the original material and is set up to a height $h_1$. This component, as represented in FIG. 7*b*, is subsequently shaped further in a second stage, a second drawing operation the radius in the transition region from the bottom to the frame being reduced, and the diameter of the bottom being reduced approximately by a further 20%, so that the height $h_2$ is increased by about 50%. At the same time, the frames are also pressed somewhat more, so that a thickness $D_2$ which is somewhat less than the thickness D of the starting material results in the frame region. The resulting component is represented in FIG. 7*c*.

In a next step, which corresponds essentially to step 3 as described above, shaping is carried out by swaging the corners, in other words the transition radius between the bottom region and the frame is greatly reduced. This is a preparation for the step, represented above in the scope of FIG. 4, for the thickening of the bottom. In this bottom swaging step as well, the bottom may be thickened further slightly, i.e. the thickness $D_3$ may be greater than the thickness $D_1$. The overall height $h_3$ is of course likewise further reduced somewhat in this step, but the aperture diameter $Dm_3$ remains approximately the same as $Dm_2$. The result is a pot as represented in FIG. 7*d*, with a sharp transition region with a small radius between the bottom and the frame.

In a fourth step, the result of which is represented in FIG. 7*e*, the bottom is now firstly thickened, essentially in a step as described above in FIG. 4. The result is a bottom with a thickness $D_4$ which is now already greater than the thickness D of the starting material. The frame regions are likewise swaged, i.e. D'4 is somewhat greater than D. The inner bottom radius $Dm_4$ is reduced in comparison with $Dm_3$ by about 20%, while the height $h_4$ remains the same, or may even be increased somewhat further.

A further step is now carried out, the result of which is represented in FIG. 7*f*, the frames being raised further while simultaneously ensuring that the radii in the transition region between the bottom and the frame remain as small as possible. The bottom is possibly thinned somewhat further to a thickness $D_5$ in the step then taking place, the result of which is represented in FIG. 7*g*, and in a second thickening step for the bottom the latter is increased further in its thickness to a final thickness $D_6$, which in this special case is almost two times as great as the thickness D of the starting material. The frames are also thickened to a thickness $D'_6$, although this is thinned in the three steps then taking place, a first step with drawing (result represented in FIG. 7*h*) successively and with a great increase in the overall height of the component to a final height $h_9$. The first step, the result of which is represented as FIG. 7*h*, is drawing, while the steps which lead to the results according to FIGS. 7*i* and *j* are effectively ironing steps, so that the wall thickness at the end ($D'_9$) is only about two thirds of the material thickness D of the starting material.

This finally results in a component in which the ratio between the wall thickness in the bottom region and the wall thickness in the frame region lies in the region of 3 to 1, starting from a starting material thickness which is substantially less than the thickness in the bottom region, and greater or even substantially greater than the final thickness in the frame region.

Figure 8:
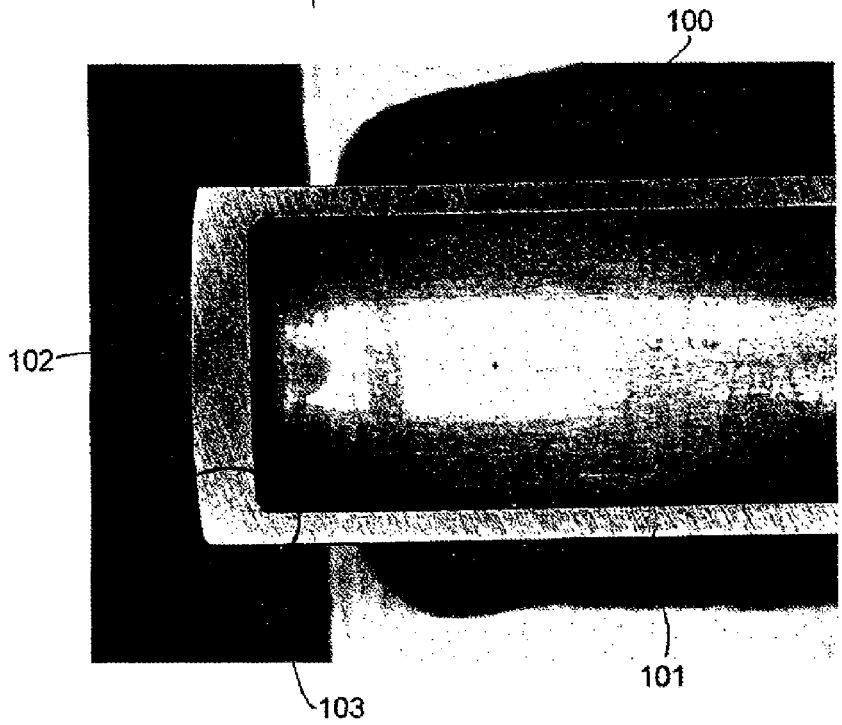
FIG. 8 shows a photographic representation of a section through a produced component.

A component resulting from this process is represented, particularly in order to illustrate the corner region 103, with very small edge radii in FIG. 8 in an axial section. It is found for this component, above all in measurements, that owing to the processes with the bottom material the latter has a substantially higher strength than when such a component is subjected only to shaping steps of a conventional type. Typically, the starting material has a Vickers hardness in the range of HV1=107-111. If a component is deep-drawn in a normal method starting from a material with a thickness of 1.1 mm, then with a bottom thickness of somewhat less than 1.1 mm the Vickers hardness in this region then lies in the range of HV10=114-119. If the bottom is increased to a thickness of 1.3 mm by using the proposed method, then a hardness of HV10=151-166 results, and even in the range of HV10=176-181 if it is increased to a thickness of 1.7 mm. Essentially measured directly over the bottom, the frame under these conditions has a hardness in the range of HV10=154-155 at the deep-drawn part before the first thickening step, HV10=185 after the thickening to a bottom thickness of 1.3 mm, and HV10=206-219 after the second thickening to 1.7 mm and subsequent deep-drawing and ironing operations to form the finished component. The yield point of the material in the bottom region is furthermore increased correspondingly, starting from base material with approximately 210 MPa, in the two deep-drawing steps to approximately 240 MPa and subsequently in the first thickening step (1.1 mm to 1.3 mm) to approximately 400 MPa. In the second thickening step (1.3 mm to 1.7 mm), a further increase in the yield point to approximately 450 MPa is achieved.

LIST OF REFERENCES

| | |
|---|---|
| 1 | blank |
| 2 | outer brace for the first step, die |
| 3 | ejector for the first step |
| 4 | punch for the first step |
| 5 | circumferential rounded region of 4 |
| 6 | wide gap between 2 and 3 |
| 7 | circumferential rounded region of 2 |
| 8 | clamped region of 1 |
| 9 | clamping region of 4 |
| 10 | gap-limiting surface of 4 |
| 11 | gap-limiting surface of 2 |
| 12 | clamping region of 3 |
| 13 | shaped section of 1 |
| 14 | gap for 13 |
| 15 | bottom region after first step |
| 16 | circumferentially rising region after first step |
| 17 | pot-shaped component after first step |
| 18 | curved transition region between 15 and 16 |
| 20 | punch for the second step |
| 21 | outer brace for the second step, die |
| 22 | ejector for the second step |
| 23 | clamped region of 17 |
| 24 | circumferential rounded region of 21 |
| 25 | circumferential rounded region of 20 |
| 26 | gap-limiting surface of 20 |
| 27 | gap-limiting surface of 21 |
| 28 | circumferential surface of 23 |
| 29 | clamping region of 22 |
| 30 | pot-shaped component after the second step |
| 31 | circumferential rising region after second step |
| 32 | bottom region after second step |
| 33 | gap for 34 |
| 34 | pressed section of 17 |
| 40 | die for the third step |
| 41 | outer brace for the third step, die |
| 42 | ejector for the third step |
| 43 | clamped region of 30 |
| 44 | circumferential rounded region of 41 |
| 45 | circumferential rounded region of 40 |
| 46 | gap-limiting surface of 40 |
| 47 | gap-limiting surface of 41 |
| 48 | circumferential surface of 43 |
| 49 | clamping region of 42 |
| 50 | pot-shaped component after the third step |
| 51 | circumferential rising region after third step |
| 52 | bottom region after third step |
| 53 | gap for 54 |
| 54 | rising section of 50 |
| 55 | retainer for the third step |
| 56 | transition region from 52 to 51, edge region |
| 70 | retainer for the fourth step |
| 71 | conical outer brace for the fourth step, die |
| 72 | ejector for the fourth step |
| 73 | clamped region of 50 |
| 74 | circumferential rounded region of 71 |
| 75 | shear element |
| 76 | shear surface of 75 |
| 77 | cone surface of 71 |
| 78 | circumferential cylindrical surface of 72 |
| 79 | clamping region of 72 |
| 80 | pot-shaped component after the fourth step |
| 81 | circumferential rising frame which widens after the fourth step |
| 82 | bottom region after the fourth step |
| 83 | cone angle of 77 |
| 84 | circumferential surface of side wall |
| 100 | finished component |
| 101 | frame of 100 |
| 102 | bottom of 100 |
| 103 | corner region of 100 |
| D | thickness |
| $D_m$ | diameter |
| H | height |

The invention claimed is:

1. A method for producing a pot-shaped component from a flat blank, wherein the pot-shaped component has a planar bottom region and a circumferential frame adjacent thereto, rising from the bottom region, wherein the blank has a first material thickness over its entire area, and wherein the bottom region has a second material thickness, which is greater than the first material thickness, and wherein the method comprises at least the following steps:

a) shaping the planar blank in at least one deep-drawing step to form a pot-shaped raw component having a planar bottom region and a circumferential frame adjacent thereto, rising from the bottom region, b) shaping that pot-shaped raw component in a tool having a conically tapering die and a shear element exerting a shear on a circumferential surface of the rising frame of the raw component in an axial direction against the conically tapering die, wherein the bottom region of the raw component is clamped at least locally between an ejector and a retainer, wherein the conically tapering die encloses the bottom region of the raw component radially on an outside surface thereof and guides the bottom region of the raw component in a diameter-reducing manner in a tool stroke, wherein a retaining force of the retainer during the shaping tool stroke in step b) is less than a counterforce of the ejector, and wherein said second material thickness is the same over the entire bottom region due to a clamping between the retainer and the ejector.

2. The method as claimed in claim 1, wherein the shear element is path-controlled.

3. The method as claimed in claim 1, wherein step a) comprises at least one first deep-drawing step for forming said rising frame, and at least one second deep-drawing step for shaping, in which a radius of a transition region between the bottom region and the rising frame is reduced.

4. The method as claimed in claim 1, wherein, following step b), the component is subjected to at least one shaping step in which the rising frame is converted from an orientation conically tapering toward the bottom region into a cylindrical orientation at least over a part of the height of the rising frame.

5. The method as claimed in claim 1, wherein the pot-shaped component is rotationally symmetrical.

6. The method as claimed in claim 1, wherein the second material thickness is at least 1.25 times as great as the first material thickness.

7. The method as claimed in claim 1, wherein the second material thickness is at least 1.5 times as great as the material thickness of the rising frame.

8. The method as claimed in claim 1, wherein the blank is of metal.

9. The method as claimed in claim 1, wherein the conically tapering die has a cone angle in the range of 3–20°.

10. The method as claimed in claim 1, wherein step b) is carried out at least two times, either immediately after one another or with at least one intermediate deep-drawing step.

11. The method as claimed in claim 1, wherein starting material is supplied in a continuous or quasi-continuous process, and the blank is cut from the starting material in at least one processing step which precedes step a).

12. The method as claimed in claim 1, wherein step a) comprises at least one first deep-drawing step for forming said rising frame, and at least one second deep-drawing step for shaping, in which a radius of a transition region between the bottom region and the rising frame is reduced, the frame being at least one of pressed and deep-drawn in a wall thickness-reducing manner or height-increasing manner in said deep-drawing step for shaping.

13. The method as claimed in claim 1, wherein, following step b), the component is subjected to at least one shaping step in which the rising frame is converted from an orientation conically tapering toward the bottom region into a circular-cylindrical orientation at least over a part of the height of the rising frame.

14. The method as claimed in claim 1, wherein, following step b), the component is subjected to at least one shaping step in which the rising frame is converted from an orientation conically tapering toward the bottom region into a circular-cylindrical orientation at least over the entire height of the rising frame, the rising frame being simultaneously at least one of pressed and/or deep-drawn so as to increase its height.

15. The method as claimed in claim 1, wherein the second material thickness is at least 1.5 times as great as the first material thickness.

16. The method as claimed in claim 1, wherein the second material thickness is at least 1.75 times as great as the first material thickness.

17. The method as claimed in claim 1, wherein the second material thickness is at least 2 times as great as the first material thickness.

18. The method as claimed in claim 1, wherein the second material thickness is at least 1.75 times as great as the material thickness of the rising frame.

19. The method as claimed in claim 1, wherein the second material thickness is at least 2 times as great as the material thickness of the rising frame.

20. The method as claimed in claim 1, wherein the second material thickness is at least 3 times as great as the material thickness of the rising frame.

21. The method as claimed in claim 1, wherein the blank is of steel.

22. The method as claimed in claim 1, wherein the blank is of a metal selected from the following group consisting of:

steel, selected from the group consisting of: DC01, DC02, DC03, DC04, DC05, DC06, 1.4016, 1.4000, 1.4510, 1.4301, 1.4303, 1.4306, 1.4401, and 1.4404;

nickel and tempered or untempered deep-drawable alloys including 2.4851;

copper and tempered or untempered deep-drawable alloys thereof, including brass;

tantalum, molybdenum and niobium and tempered and untempered deep-drawable alloys thereof;

tungsten and tempered or untempered deep-drawable alloys thereof, including tungsten with rhenium being alloyed in addition;

aluminum and tempered and untempered deep-drawable alloys thereof, including aluminium with magnesium being alloyed in addition; and magnesium and tempered and untempered deep-drawable alloys thereof, including magnesium with lithium or aluminum being alloyed in addition, including the alloy AZ31 and combinations and alloys of these materials.

23. The method as claimed in claim 1, wherein the conically tapering die has a cone angle in the range of 5–15°.

24. The method as claimed in claim 1, wherein step b) is carried out at least two times, either immediately after one another or with at least one intermediate deep-drawing step, in which the rising frame is converted from an orientation conically tapering toward the bottom region into a circular-cylindrical, orientation at least over the entire height, of the rising frame.

25. The method as claimed in claim 1, wherein step b) is carried out at least two times, either immediately after one another or with at least one intermediate deep-drawing step, in which the rising frame is converted from an orientation conically tapering toward the bottom region into a cylindrical orientation at least over a part of the height of the rising frame.

26. The method as claimed in claim 1, wherein starting material is supplied in a continuous or quasi-continuous process, from a roll, and the blank is cut by stamping, from the starting material in at least one processing step which precedes step a).

27. The method as claimed in claim 1, wherein step a) comprises at least one first deep-drawing step for forming said rising frame, and at least one second deep-drawing step for shaping, in which a radius of a transition region between the bottom region and the rising frame is reduced, the rising frame being further at least one of pressed and deep-drawn in a wall thickness-reducing manner or height-increasing manner in at least one further step.

28. The method as claimed in claim 1, wherein, following step b), the component is subjected to at least one shaping step in which the frame is converted from an orientation conically tapering toward the bottom region into a circular-cylindrical orientation at least over the entire height of the rising frame, the rising frame being at least one of pressed and deep-drawn so as to increase its height or in one or more additional pressing or deep-drawing steps.

* * * * *